United States Patent [19]

Bouchon

[11] 4,399,984

[45] Aug. 23, 1983

[54] AUTOMATIC INSTALLATION FOR THE HEAT TREATMENT OF WORKPIECES IN FLUIDIZED BEDS

[75] Inventor: Jean-Claude M. Bouchon, Poissy, France

[73] Assignee: Midland-Ross Corporation, Cleveland, Ohio

[21] Appl. No.: 346,530

[22] Filed: Feb. 8, 1982

[51] Int. Cl.[3] ..... C21D 9/567

[52] U.S. Cl. ..... 266/252; 266/172; 266/249; 266/110; 266/103; 432/134; 34/164

[58] Field of Search ..... 266/172, 252, 249, 251; 148/16, 20.3, 13.1, 153, 155, 157; 432/15, 58, 134, 14; 34/164; 198/756

[56] References Cited

U.S. PATENT DOCUMENTS

| | | | |
|---|---|---|---|
| 2,918,070 | 12/1959 | Carrier, Jr. | 134/132 |
| 3,469,831 | 9/1969 | Beavers | 266/130 |
| 3,550,922 | 12/1970 | Giepel et al. | 432/58 |
| 4,029,524 | 6/1977 | Takahashi et al. | 148/13.1 |
| 4,154,574 | 5/1979 | Keirle et al. | 266/172 |
| 4,249,889 | 2/1981 | Kemp | 432/11 |

*Primary Examiner*—L. Dewayne Rutledge
*Assistant Examiner*—Christopher W. Brody
*Attorney, Agent, or Firm*—H. Duane Switzer

[57] ABSTRACT

Workpieces are heat treated in a fluidized bed contained within a vessel having a central well surrounded by helical ramps along which the workpieces move into and out of the bed. A perforated platform connects the ramp and movement of the workpieces along the discharge ramp is achieved by vibrating such ramp.

7 Claims, 4 Drawing Figures

AUTOMATIC INSTALLATION FOR THE HEAT TREATMENT OF WORKPIECES IN FLUIDIZED BEDS

BACKGROUND OF THE INVENTION

The present invention relates to an automatic installation for the heat treatment of workpieces in fluidized beds.

Methods and installations for improving heat exchanges between a fluidized bed of solid particles and workpieces to be treated are already known through the French Pat. No. 70 21 613, filed on June 12, 1970, and its Addition No. 71 19 245, filed on May 27, 1971, which consist in maintaining the workpieces in an open-top vessel comprising a bottom structure adapted to retain the workpieces, while permitting the passage of the fluidized particles, and immerging this vessel into the fluidized bed, whereby an upward circulation of the fluidized particles takes place within the vessel through the workpieces to be treated, such that the deeper the immersion of said vessel into the fluidized bed, the stronger the circulation of fluidized particles.

When carrying out this method, a problem arises when introducing and retracting the workpieces to and from the fluidized bed. Two solutions have been proposed to cope with this problem:

In the first solution, in the case of a discontinuous operation, the workpieces to be treated are disposed in containers or wire-racks which are subsequently immersed into the fluidized bed; and, In the second solution, permitting an automatic and continuous operation, the workpieces are disposed in wire-racks and transported by means of an elevator capable of immersing and extracting the wire-racks into and from the fluidized bed, the elevator station comprising horizontal beams along which trolleys or like carriers supporting the wire-rack gripping means are adapted to travel. A typical example of an automatic installation of this character is disclosed in the French Pat. No. 79 02 967, filed on Feb. 6, 1979, by the same applicant.

The first solution is objectionable, in that it permits only a discontinuous operation, with separate and successive charges, and the second solution is awkward, in that mechanical parts are handled in the fluidized bed and that the installation necessary therefor has excessive overall dimensions.

SUMMARY OF THE INVENTION

It is the primary object of the present invention to provide an installation free of the various inconveniences characterizing the above-mentioned solutions.

For this prupose, the present invention is directed to provide an automatic installation for the heat treatment of workpieces in a fluidized bed, wherein the workpieces are immersed into a fluidized bed and extracted continuously therefrom upon completion of the desired treatment, this installation being characterized in that the treatment vessel containing the fluidized bed incorporates a central well provided with a helical feed ramp for introducing the parts to be treated, said central well being further provided, at its lower portion, with a perforated platform adapted to feed the workpieces to another helical ramp directing the workpieces toward the upper portion of the fluidized bed, in order to permit the extraction of the workpieces upon completion of the heat treatment, the workpieces being moved along the second helical ramp by causing the complete elevator system to vibrate.

According to a specific feature characterizing this invention, the helical feed ramp provided for introducing the workpieces to be treated into the fluidized bed has a relatively fast pitch, and the helix of the ramp for extracting the treated workpieces has a moderate pitch, the pitches of the two helices being selected, for example, as a function of the dwelling time of the workpieces in the fluidized bed, that is, as a function of the heat treatment time.

According to a first form of embodiment of the installation according to the present invention, the central well comprises two annular concentric cylindrical portions, the inner annular portion of which is adapted to accommodate the feed ramp for introducing the workpieces into the bed, and the outer annular portion is provided with the workpiece extraction ramp, the elevator system being set to vibrate by means of at least one motor adapted to transmit a vibratory motion to the central well structure.

According to a second form of embodiment of the installation of this invention, the central well comprises an annular portion receiving the feed ramp, and the workpiece removal ramp is disposed between the outer wall of the well and the wall of the surrounding vessel containing the fluidized bed, the elevator system being adapted to be vibrated by using a motor causing the vibration of the complete fluidized bed.

In a third form of embodiment of an installation according to the instant invention, the central well receives a helical ramp adapted to extract the treated workpieces, the movement of which is caused by a motor capable of causing the well and the extraction ramp to vibrate, and the helical ramp feeding the workpieces to be treated is positioned around the central well, along the wall of the vessel containing the fluidized bed, which is vibrated by a separate motor.

The device of this invention may be constructed with a view to perform a continuous thermal treatment at several temperature levels, for example for adhering to a thermal cycle comprising a preheating phase at a predetermined temperature, followed by the normal heating phase and a hardening phase. To this end, a modified embodiment is contemplated for the present invention, which is characterized in that it comprises, disposed in a vertical or horizontal plane, a series of successive fluidized beds, each provided with the above-mentioned means for introducing and removing the workpieces, the latter passing automatically from one fluidized bed to the next fluidized bed by means of a vibrating transfer means disposed between the spout of the extraction ramp of a fluidized and the spout of the ramp for introducing the workpieces into the next fluidized bed, or by gravity.

BRIEF DESCRIPTION OF THE DRAWING

Other features and advantages of this invention will appear more clearly as the following description proceeds, with reference to the accompanying drawings illustrating various possible forms of embodiment of the invention, given by way of example, not of limitation. In the drawings.

DESCRIPTION OF A PREFERRED EMBODIMENT

Figure 1:
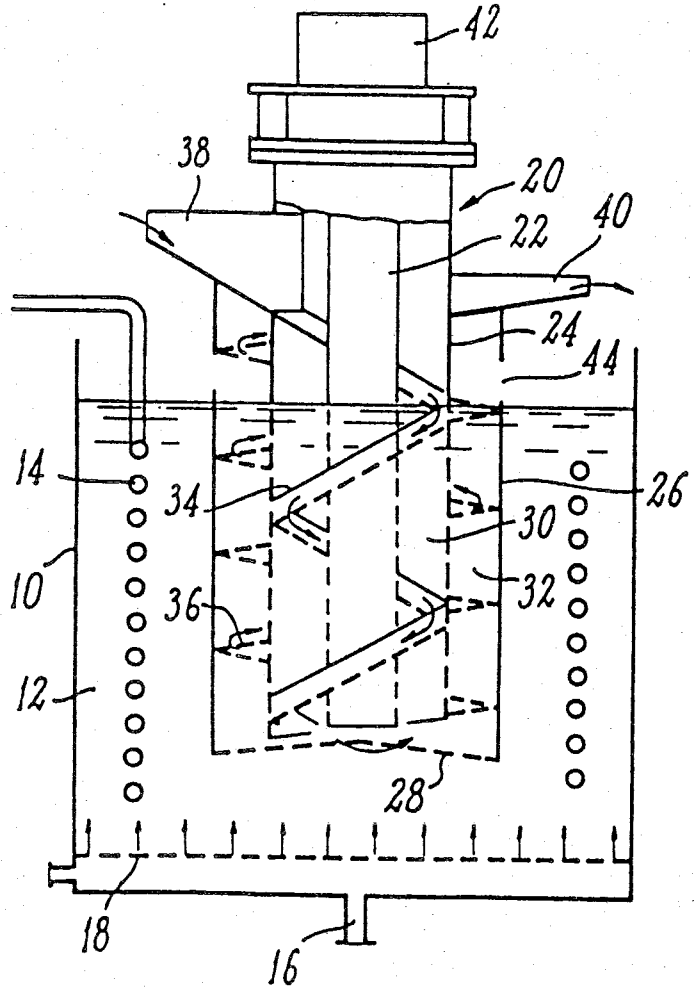
FIG. 1 is a diagrammatic elevational view showing a first form of embodiment of a fluidized bed heat-treatment installation according to the present invention.

Considering firstly FIG. 1, reference numeral 10 designates the vessel containing the particles constituting the fluidized bed 12. These particles are fluidized in the known fashion, by means of a combustion gas introduced through an inlet 16 at the bottom of vessel 10, just under a grid 18 supporting the bed-forming particles. Still in the known fashion, the (thermofluid) particles are brought to the desired temperature by a heat carrier fluid medium circulating in an array of tubes 14 immersed in the bed.

According to the invention, a central well, designated generally by reference numeral 20, is erected in the fluidized bed 12. In this first example, the central well 20 comprises a central shaft 22, an inner cylindrical wall 24, and an outer cylindrical wall 26. This well is closed at its bottom by a platform 28 of conical configuration, consisting of a perforated plate permitting the passage of the fluidized bed particles therethrough, but preventing the passage of the workpieces to be treated. The annular space 30 formed between the central shaft 22 and cylindrical wall 24 is utilized for the downward circulation of the workpieces to be treated, which are introduced into the well by means of a spout 38. For this purpose, a helical ramp 34 having a relatively fast pitch is disposed in said annular space 30, the workpieces to be treated descending along this ramp and penetrating into the fluidized bed, down to the platform 28. The function of the annular space 32, concentric to annular space 30 and formed between the cylindrical walls 24 and 26, is to cause the upward movement of the treated workpieces through the fluidized bed until they are extracted therefrom by means of a spout 40. For this purpose, a low-pitch annular helical ramp 36 is provided in this annular space 32, the workpieces from the inner ramp 34 being transferred to this ramp 36 by means of the aforesaid perforated platform 28, as shown by the arrows in FIG. 1. To propel the workpieces along the extraction ramp, the thus constituted elevator system is set to vibrate by means of a motor 42. Of course, the cylindrical outer wall 26 of central well 20 comprises a plurality of upper apertures 44 permitting the free flow of the solid particles through the bed, as explained in the above-mentioned French Pat. No. 70 21 613.

Figure 2:
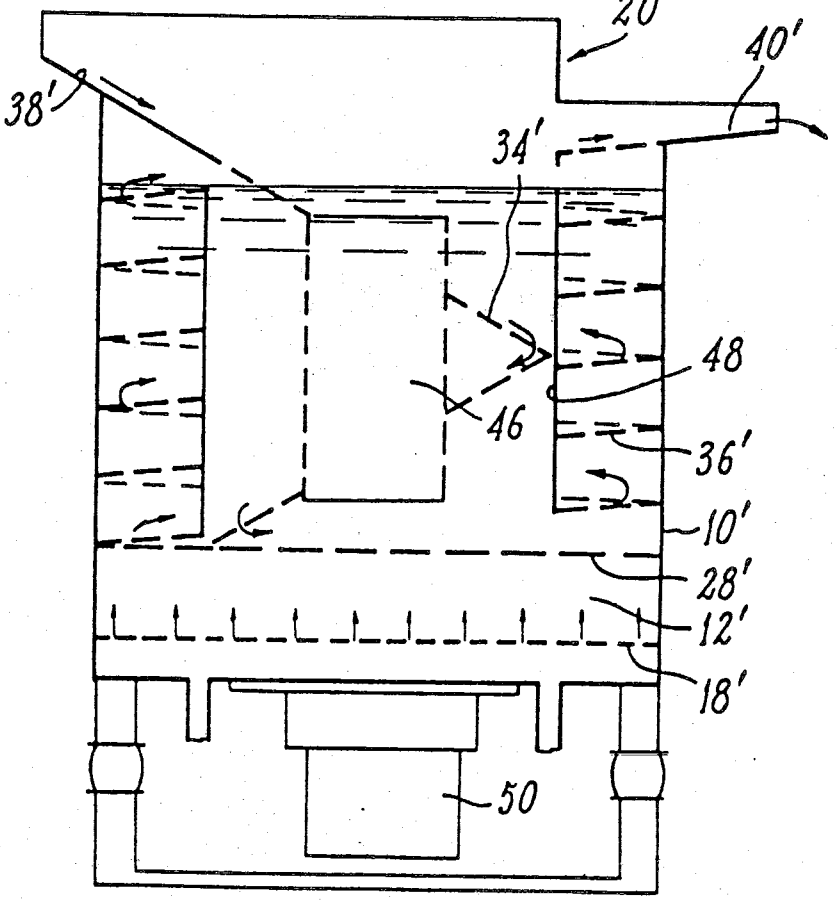
FIG. 2 is a diagrammatic view, similar to FIG. 1, showing a modified form of embodiment in which the fluidized bed is caused to vibrate.

The second form of embodiment illustrated in FIG. 2 differs from the first one by the design of the central well 20'. This modified well structure comprises a central shaft 46, disposed inside a concentric cylindrical outer wall 48, the helical feed ramp 34' being disposed between the central shaft 46 and the outer wall 48, the extraction ramp 36' being located between the wall of vessel 10' and this wall 48. As in the example illustrated in FIG. 1, the workpieces to be treated are introduced through a spout 38', and the treated workpieces are discharged through another spout 40'. In this modified construction, the workpieces are caused to move along the extraction ramp 36' by the vibratory motion imparted by a motor 50 to the vessel 10' containing the fluidized bed, the central well 20', and the feed and extraction ramps 34' and 36'.

Figure 3:
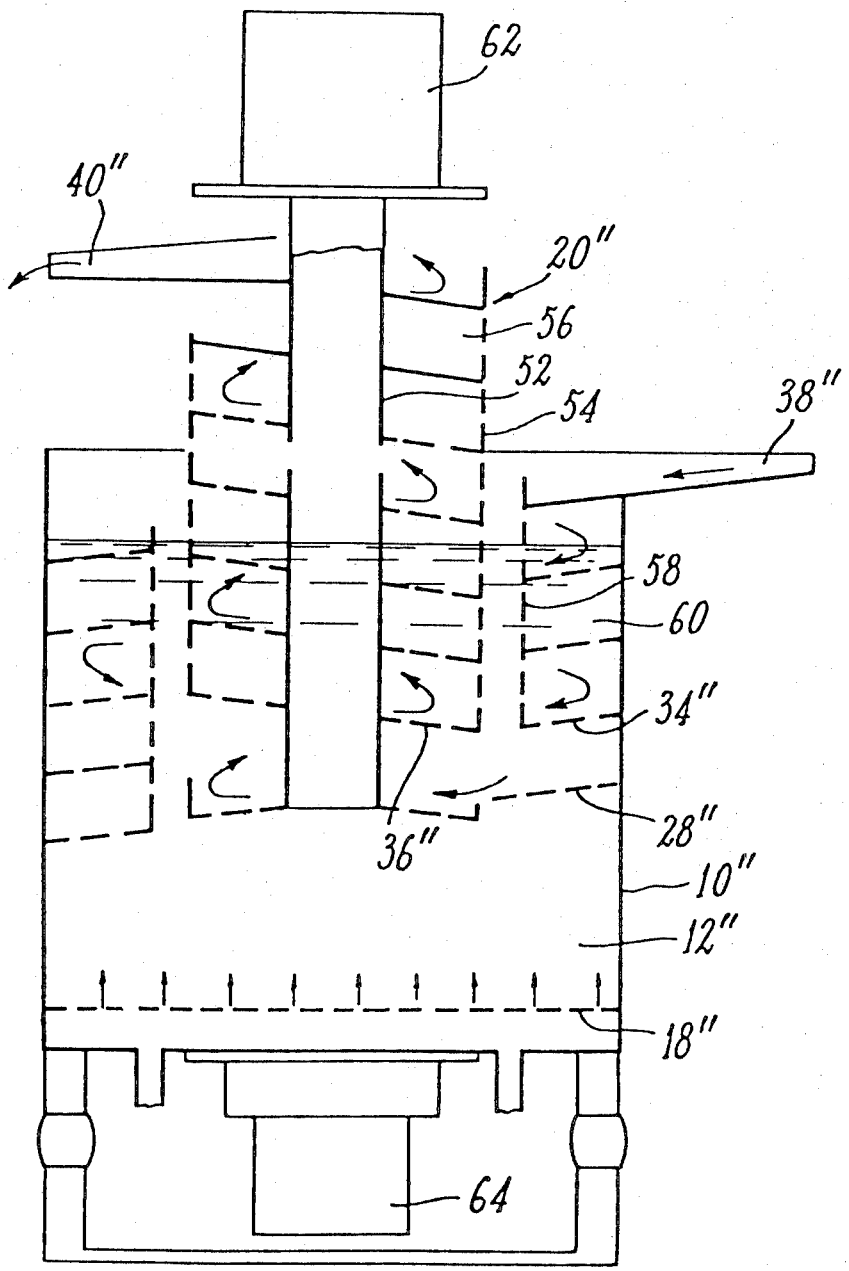
FIG. 3 is a diagrammatic elevational view showing another typical form of embodiment of the installation according to the instant invention; and, FIG. 4 is an elevational view showing an installation according to the present invention for the continuous heat treatment of workpieces of relatively small dimensions, which implies a heating and hardening cycle.

In a further form of embodiment shown in FIG. 3, the workpieces to be treated are fed to the outer peripheral or marginal portion of the fluidized bed, and the treated workpieces are removed from the center. To this end, the central well 20" comprises a central shaft 52 and a cylindrical wall 54 defining an annular space 56, in which the helical ramp 36", for removing the workpieces treated in the fluidized bed 12", is disposed. This elevator is vibrated by means of a motor 62, mounted on top of central shaft 52. The plant is supplied with workpieces to be treated by means of a helical ramp 34", located between the outer wall 10" of the vessel and a cylindrical wall 58 concentric thereto. The complete fluidized bed is vibrated by means of a spearate motor 64.

It will be readily apparent, from this FIG. 3, that the workpieces introduced by means of the outer peripheral spout 38" will firstly slide along the feed ramp 34" through the fluidized bed, and, when the workpieces reach the bottom of ramp 34", they are transferred to central well 20" by a perforated inclined platform 28", whereafter they start their upward travel along the removal ramp 36". The treated workpieces are eventually discharged through spout 40".

The installation according to the present invention may be designed for carrying out a continuous thermal treatment comprising several sequential operations such as, notably, heating and hardening. A typical example of an installation of this specific type is illustrated in FIG. 4 of the drawings.

This installation comprises two identical fluidized beds 70 and 80. The workpieces are firstly heated in bed 70, and then hardened in bed 80. Each section of the installation mounted in fluidized beds 70 and 80 is designed like the device described hereinabove, with reference to FIG. 2.

The vessel 72 containing fluidized bed 70 comprises a central well 74, in which the helical ramp 76 for introducing the workpieces is mounted, the helical workpiece extraction ramp 78 being disposed between the well 74 and the outer wall of vessel 72. The same component elements (i.e., central well 84, feed ramp 86 and extraction ramp 88) are also found in vessel 82, containing the fluidized bed 80, in which the workpieces previously heated in bed 70 are hardened. The workpieces are transported from bed 70 to bed 80 by a high-speed vibrating system 90, driven by a motor 92. On the other hand, the elevators and fluidized beds are vibrated by motors 94, 96 and 98, 100, respectively.

Figure 4:
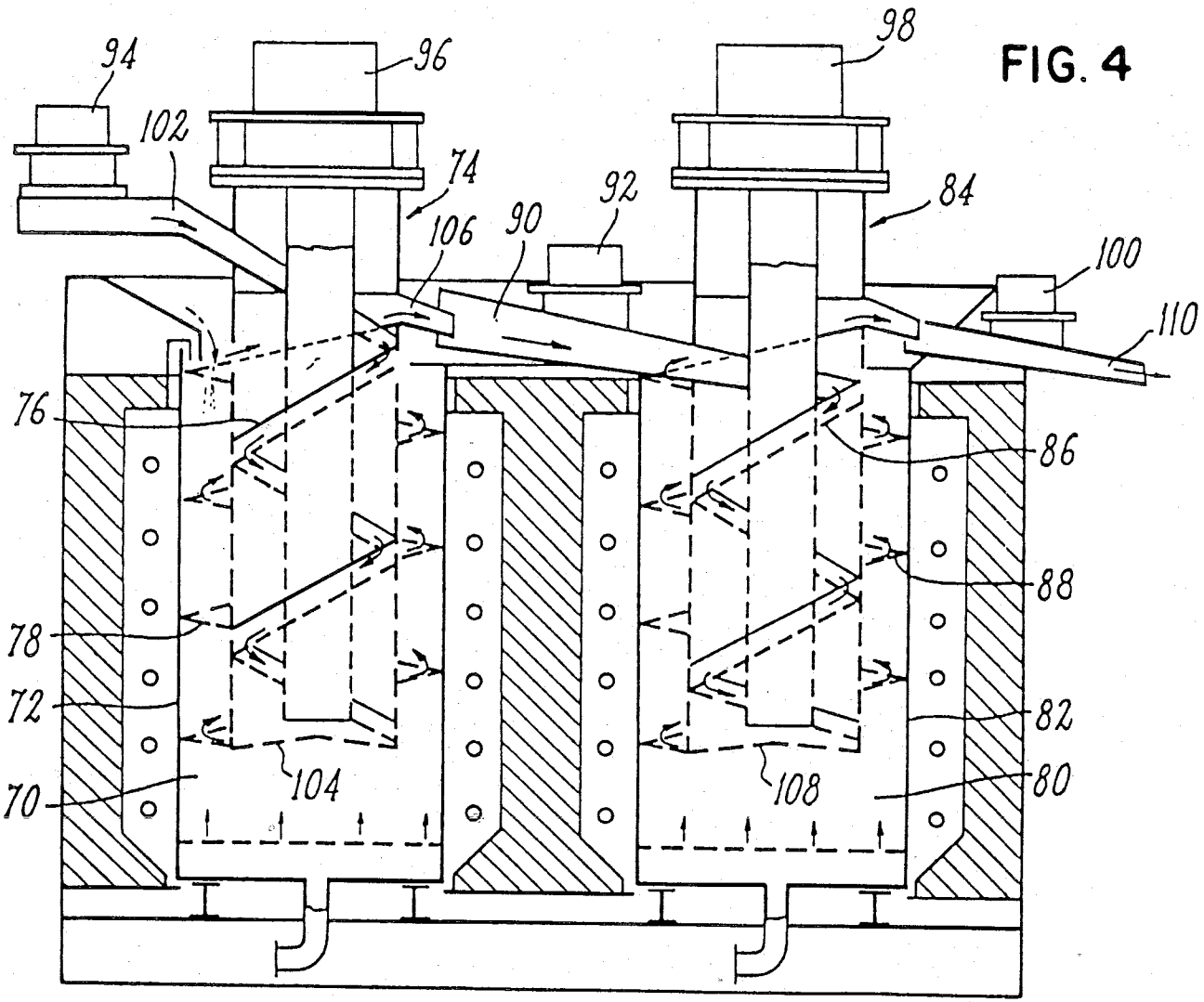

From FIG. 4, it will be seen that the workpieces introduced by means of spout 102 into the central well 74 will move along the feed ramp 76 through the bed of fluidized particles 70, so as to be heated thereby; from the bottom of this well, the workpieces are transported by the perforated platform 104 to the external discharge ramp 78, which causes the workpieces to pass again through the bed 70 in the reverse direction, i.e. upwards, until they reach the outlet spout 106, from which the workpieces are taken out by the vibrating transport device 90, and delivered to the next fluidized bed 80, in which they are subsequently hardened.

The workpieces to be hardened move along the ramp 86 and through the particles constituting the bed 80; at the bottom of the well, they are transferred by the perforated platform 108 to the outer discharge ramp 88, causing the workpieces to pass again subsequently upwardly through the bed of fluidized particles, the workpieces eventually reaching the spout 110, from which they are discharged.

Of course, more than two fluidized beds may be contemplated, as a function of the heat cycle to be accomplished. Similarly, a vertical arrangement of various fluidized beds, or any other suitable arrangement, may also be contemplated without departing from the frame of this invention.

From the above description, it will be readily apparent to those conversant with the art that the installation according to the present invention provides both and simultaneously the regularity of the treatment cycle and the continuous travel of the workpieces through the treatment vessel, or vessels.

The essential advantages deriving from the operation of the installation of this invention are:

- a minimum floor space;
- a maximum useful operating length;
- the absence of mechanical moving parts;
- the possibility of bringing production changes during the plant operation;
- the elimination of any human intervention;
- the elimination of any shock between workpieces;
- the sustained self-circulation of the fluidized bed particles;
- the elimination of any particles slope during the treatment;
- the individualization of workpieces;
- improved heat exchanges and homogeneity of the medium;
- the possibility of adjusting the dwelling time of the workpieces in the fluidized beds, by adjusting the feed and/or extraction rates;
- the production of dust-free treated workpieces;
- the possibility of adapting the installation to a large range of workpieces of different shapes and dimensions.

Of course, this invention should not be construed as being strictly limited by the specific forms of embodiment described and illustrated herein, since many modifications and changes may be brought thereto without departing from the basic principles of the invention. Thus, more particularly, the various ramps for introducing the workpieces to be treated, extracting the treated workpieces, as well as the feed ramps, may be perforated or not, as desired.

What is claimed:

1. An apparatus for heat treating articles in a fluidized bed of heated particles, said apparatus comprising: a fluidized bed of heated particles, and a vibrating conveyor for moving said articles through said bed, said conveyor including a cylindrical member, first helical ramp means coaxial with said cylindrical member for guiding the articles into said fluidized bed, second helical ramp means coaxial with said first ramp means and said cylindrical member for guiding the articles out of said fluidized bed, at least one of said first and second ramp means being connected with said cylindrical member, a platform at least partially closing one end of said cylindrical member for receiving articles from said first ramp means, moving said articles radially, and for thereafter transferring said articles to said second ramp means, said platform being formed of material having perforations smaller than the articles being heat treated and substantially larger than the heated particles, and means for vibrating said cylindrical member, said first and second ramp means, and said platform to cause said articles to advance along said first ramp means onto said platform, and onto said second ramp means to thereby move said articles into and out of said fluidized bed.

2. The apparatus as defined in claim 1 wherein said first ramp means has a relatively steep pitch and said second ramp means has a relatively small pitch, the pitches of the two helices being selected to control the time the articles remain in said fluidized bed.

3. The apparatus as defined in claim 2 wherein said first ramp means is located radially inward of said second ramp means.

4. The apparatus as defined in claim 2 wherein said first ramp means is disposed radially outward of said second ramp means.

5. The apparatus as defined in claim 1 wherein said first ramp means is connected with an inside surface of said cylindrical member and said second ramp means is connected with an outside surface of said cylindrical member.

6. The apparatus as defined in claim 1 wherein said first ramp means is connected with said cylindrical member, said fluidized bed having a cylindrical container coaxial with and surrounding said cylindrical member, said second ramp means being connected with an inside surface of said cylindrical container, and said vibrating means includes means for vibrating said cylindrical container with said cylindrical member.

7. The apparatus as defined in claim 1 wherein said fluidized bed includes a cylindrical container coaxial with and surrounding said cylindrical member, said first ramp means being connected with said container and said second ramp means being connected with said cylindrical member, and said vibrating means includes first vibrating means for vibrating said cylindrical member, said platform and said second ramp means, and second vibrating means for vibrating said cylindrical container and said first ramp means.

* * * * *